US006098373A

United States Patent [19]

Ashikawa et al.

[11] Patent Number: 6,098,373

[45] Date of Patent: Aug. 8, 2000

[54] STRAP PROCESSING APPARATUS AND A PAPER PROCESSING APPARATUS

[75] Inventors: Yoshiaki Ashikawa, Mishima; Hideki Matsumoto, Ichikawa; Toshiyuki Miyano, Kawasaki; Toshinori Utsugi, Tokyo, all of Japan

[73] Assignee: Kabushiki Kaisha Toshiba, Kawasaki, Japan

[21] Appl. No.: 09/273,761

[22] Filed: Mar. 22, 1999

[30] Foreign Application Priority Data

Mar. 24, 1998 [JP] Japan ..... 10-075695

[51] Int. Cl.[7] ..... B65B 69/00

[52] U.S. Cl. ..... 53/381.2; 83/176; 83/167; 83/151; 83/909; 83/935

[58] Field of Search ..... 53/381.2; 414/412; 83/408, 909, 935, 167, 176, 151, 335

[56] References Cited

U.S. PATENT DOCUMENTS

| | | | |
|---|---|---|---|
| 4,414,730 | 11/1983 | Ohmura et al. | 29/426.3 |
| 4,586,232 | 5/1986 | Ohmura et al. | 83/909 X |
| 5,090,573 | 2/1992 | Takahashi et al. | 209/534 |

FOREIGN PATENT DOCUMENTS

| | | |
|---|---|---|
| 0 106 277 | 4/1984 | European Pat. Off. . |
| 0 460 443 | 12/1991 | European Pat. Off. . |
| 0 770 548 | 5/1997 | European Pat. Off. . |
| 40 10813 | 10/1990 | Germany . |
| 2 076 355 | 12/1981 | United Kingdom . |

*Primary Examiner*—M. Rachuba
*Assistant Examiner*—Dominic Troiano
*Attorney, Agent, or Firm*—Pillsbury Madison & Sutro Intellectual Property Group

[57] ABSTRACT

The strap processing apparatus comprises a first carrying conveyer for carrying a bundle of a predetermined number of layered valuable papers sealed with a sealing strap, a second carrying conveyer and an upper conveyer for bending the bundle of layered valuable papers carried by the carrying means thereby to form a clearance between the upper surface portion of the layered valuable papers and the sealing strap, a pair of strap catchers for clamping a portion of the sealing strap lifted apart from the upper surface portion of the layered valuable papers with a predetermined distance maintained between the pair of strap catchers each other, and a cutter for cutting an intermediate portion of the sealing strap clamped by the pair of strap catchers.

8 Claims, 18 Drawing Sheets

STRAP PROCESSING APPARATUS AND A PAPER PROCESSING APPARATUS

BACKGROUND OF THE INVENTION

The present invention relates to a strap processing apparatus and a paper processing apparatus for cutting and removing a strap which seals valuable papers, comprised in a valuable paper processing apparatus, for example.

A valuable paper processing apparatus has a pick-up portion which takes in a sheaf consisting of a predetermined number of bundles of valuable papers. Each bundle of valuable papers consists of a predetermined number (e.g. 100 sheets) of valuable papers layered and sealed with a sealing strap (which will be hereinafter referred to as a small strap). Each sheaf consists of bundles piled up and united with a unit strap (which will be hereinafter referred to as a large strap) wrapped in the form of a cross.

A sheaf taken in by the pick-up portion is fed to a large-strap removing portion and the large strap is removed. The sheaf from which the large strap has thus been removed (which means an unsealed sheaf) is fed to an extracting portion and the bundles are extracted one by one. These bundles are fed to a small-strap-removing portion and the small strap is removed. Every bundle from which the small strap has been removed (which means an unsealed bundle) is fed to a feeding portion. From the unsealed bundle, valuable papers are taken and fed to an inspecting portion one by one. Valuable papers are inspected depending on types or the like and then classified based on the result of the inspection.

Meanwhile, when removing the small strap, a portion of the small strap along one side surface of the layered valuable papers is clamped by a clamping device, together with the papers, and in this state, that portion of the small strap along the other side surface of the layered valuable papers is cut by a cutter. After cutting, only the small strap is pulled and removed out from the valuable papers. Then, the cut and removed small straps are carried to and collected in a cassette.

However, in conventional cases, when the small strap of the bundle is cut, there is a possibility that the valuable papers may be damaged because the cutter bites into the valuable papers.

Also, there is a problem that several of the valuable papers may fall due to friction when the small strap is pulled out.

Further, when collecting cut-out small straps, the straps are pushed into the cassette simply with any part of each strap held, so that the small straps are stored in various situations. Thus, the small straps cannot be stored orderly in the cassette but are stored in wrong order. As a result of being in the wrong order, it takes much time and labor to later process and check the serial numbers of the small straps, which are recorded thereto.

BRIEF SUMMARY OF THE INVENTION

The present invention hence has an object of providing a strap processing apparatus and a paper processing apparatus, which can cut off the sealing paper straps without damaging the papers, remove them without dropping the papers, and store the straps in the order which are cut off.

The present invention comprises: carrying means for carrying a bundle of papers, consisting of a predetermined number of papers sealed with a sealing strap; clearance forming means for bending the bundle of papers carried by the carrying means, thereby to form a clearance between an upper surface portion of the layered papers and the sealing strap; a pair of clamping means for clamping a portion of the sealing strap lifted apart from the upper surface of the layered papers, with a predetermined distance maintained between the pair of clamping means each other, after forming the clearance; and cutting means for cutting an intermediate portion of the sealing strap clamped by the pair of clamping means.

Also, the present invention comprises: carrying means for carrying a bundle of papers, which includes a predetermined number of papers sealed with a sealing strap; clearance forming means for bending the bundle of papers carried by the carrying means, thereby to form a clearance between an upper surface portion of the layered papers and the sealing strap; a pair of clamping means for clamping a portion of the sealing strap lifted apart from the upper surface of the layered papers, with a predetermined distance maintained between the pair of clamping means each other, after forming the clearance; cutting means for cutting an intermediate portion of the sealing strap clamped by the pair of clamping means; moving means for moving the pair of clamping means in a direction in which the pair of clamping means are moved apart from each other thereby to loosen the sealing strap, after cutting the sealing strap by the cutting means; and extracting means for clamping and carrying the papers, thereby extracting the papers from the sealing strap, after the sealing strap is loosened by the moving means so that the layered papers are rendered horizontal.

Further, the present invention comprises: carrying means for carrying a bundle of papers, which includes a predetermined number of papers sealed with a sealing strap; clearance forming means for bending the bundle of papers carried by the carrying means, thereby to form a clearance between an upper surface portion of the layered papers and the sealing strap; a pair of clamping means for clamping a portion of the sealing strap lifted apart from the upper surface of the layered papers, with a predetermined distance maintained between the pair of clamping means each other, after forming the clearance; cutting means for cutting an intermediate portion of the sealing strap clamped by the pair of clamping means; moving means for moving the pair of clamping means in a direction in which the pair of clamping means are moved apart from each other thereby to loosen the sealing strap, after cutting the sealing strap by the cutting means; extracting means for clamping and carrying the papers, thereby extracting the papers from the sealing strap, after the sealing strap is loosened by the moving means so that the layered papers are rendered horizontal; controlling means for making control such that the pair of clamping means are returned to an initial position by the moving means, after the layered papers are extracted from the sealing strap by the extracting means; strap carrying means for clamping both end portions of the sealing strap to receive the sealing strap and for carrying the sealing strap, after the pair of clamping means are returned to the initial position; and collecting means for receiving and storing the sealing strap carried by the strap carrying means, into a cassette.

According to the structure as described above, it is possible to cut the sealing strap without making the cutting means contact with the papers so that the papers can be prevented from damages.

Also, since the layered papers can be extracted by loosening the sealing strap after the sealing strap is cut, the papers can be prevented from falling when extracting the papers.

Further, when collecting the sealing straps which have been pulled out, the sealing straps can be pushed into the cassette with the sealing straps kept in the same situations as they were sealed. Therefore, the sealing straps can be stored therein orderly without changing the order of the sealing straps in the cassette.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An embodiment of the present invention will be described in details with reference to the accompanying drawings.

Figure 1:
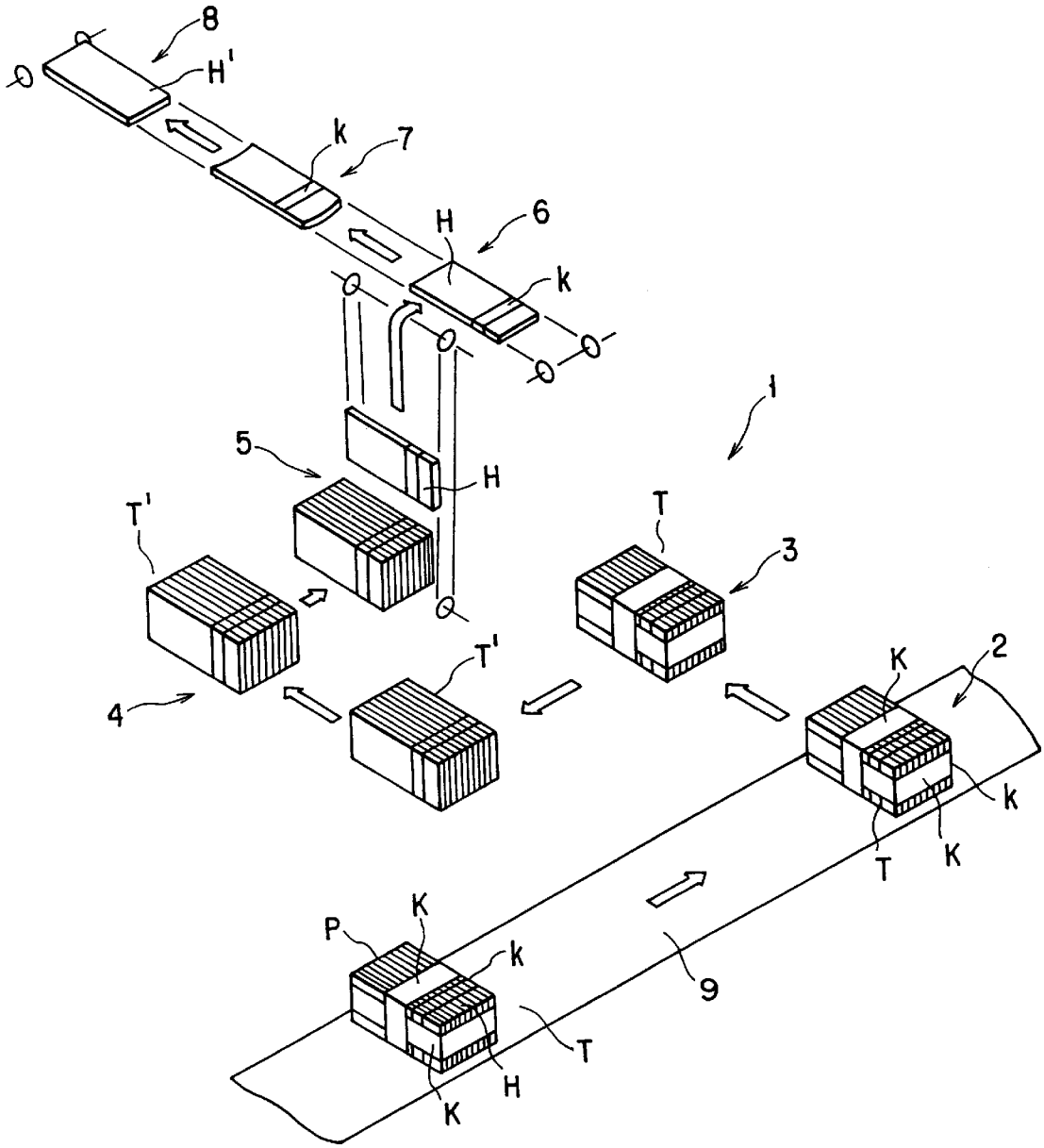
FIG. 1 is a perspective view showing the flow of the valuable papers in the strap processing apparatus according to the present invention.

FIG. 1 shows the flow of bundles H of valuable papers P and sheaf T as papers in the sealing strap processing apparatus 1.

A bundle H is comprised of a predetermined number of layered valuable papers P and each held together or sealed with a small strap k as a sealing strap. A sheaf T is comprised of a predetermined number of bundles H united with large straps as uniting straps wrapped in a cross shape. A number of sheaves T are carried one after another to the sealing strap processing apparatus by a bundle-supplying belt 9.

A sheaf T carried by the bundle-supplying belt 9 is taken in by a bundle pick-up portion 2 and the large straps K are removed from the sheaf T, by a large strap removing portion 3, so that the sheaf T then becomes an unsealed sheaf T'. The unsealed sheaves T' are then picked out one by one and fed to a bundle extracting portion 5 by an unsealed-sheaf carrying portion 4. An extracted bundle H is carried to a small strap removing portion 7 by a bundle carrying portion 6 and the small strap k is removed so that the bundle H becomes an unsealed bundle H'. The unsealed bundle H' is picked up and fed by an unsealed-bundle carrying portion 8 to a valuable paper supply/pick-up device which will be mentioned later.

Figure 2:
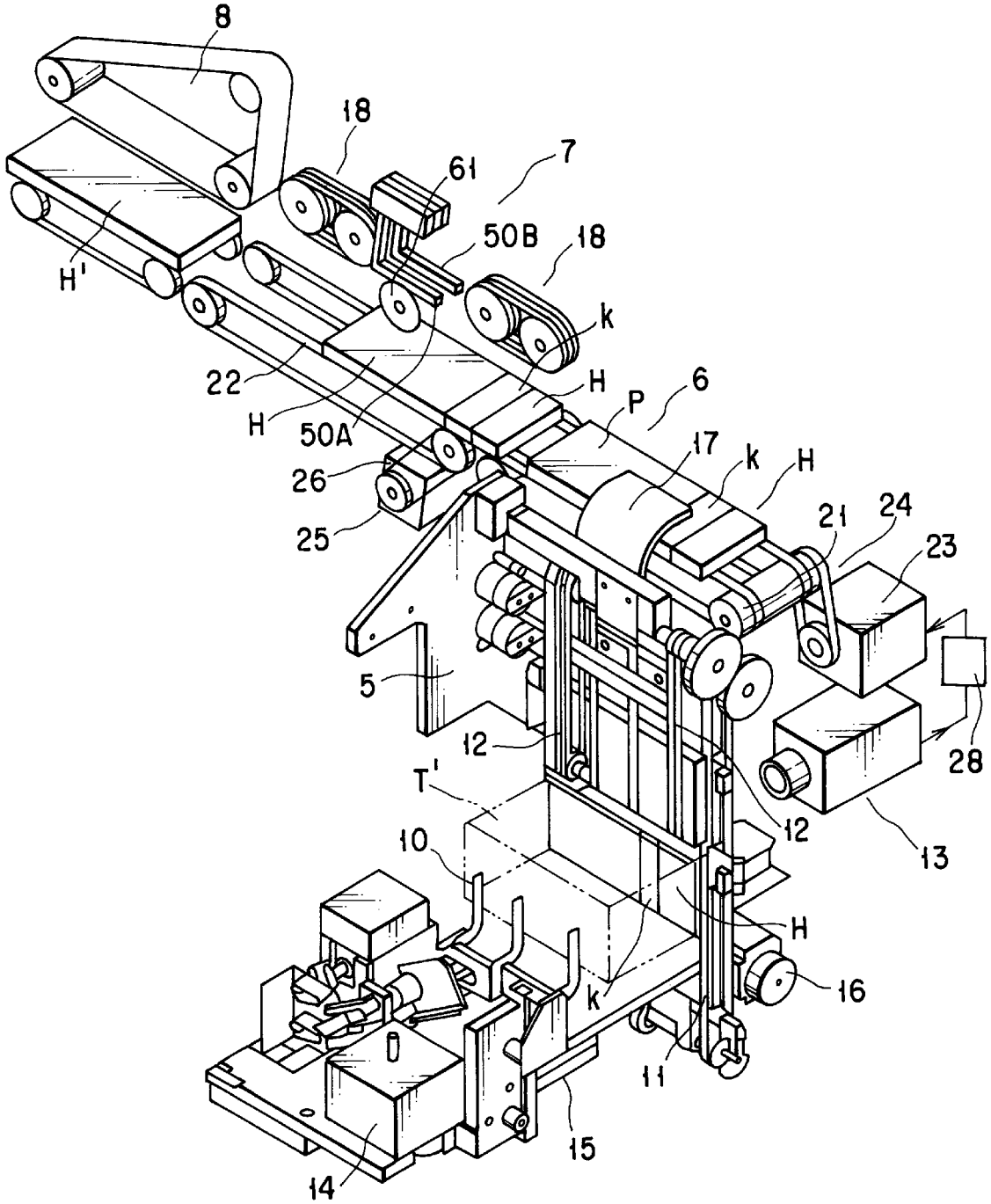
FIG. 2 is a perspective view showing the bundle pick-up portion and the small strap removing portion.

FIG. 2 is a perspective view that shows in detail the bundle extracting portion 5 and a bundle carrying portion 6 described above.

The bundle extracting portion 5 comprises a slider 10 to push the unsealed sheaf T' against an extraction reference level surface. On the side of the extraction reference level surface, an inner carrying belt 11 and an outer carrying belt 12 are provided in order to pick up and carry the bundles H one by one.

A driving motor 14 is connected to the slider 10 through a timing belt 15. A belt driving motor 16 is connected to the inner carrying belt 11 and outer carrying belt 12 through a power transmission system not shown in the figure. A camera 13 is provided close to the inner carrying belt 11 in order to detect the position of the small strap k wrapping the bundle H.

The bundle carrying portion 6 comprises a first carrying conveyer 21 to carry the bundle H to a reference position of the small strap removing portion 7, and a second carrying conveyer 22 as a clearance forming/pulling-out means which is continuous to the first carrying conveyer 21. A driving motor 25 is connected to the second carrying conveyer 22 through a timing belt 26.

Figure 3:
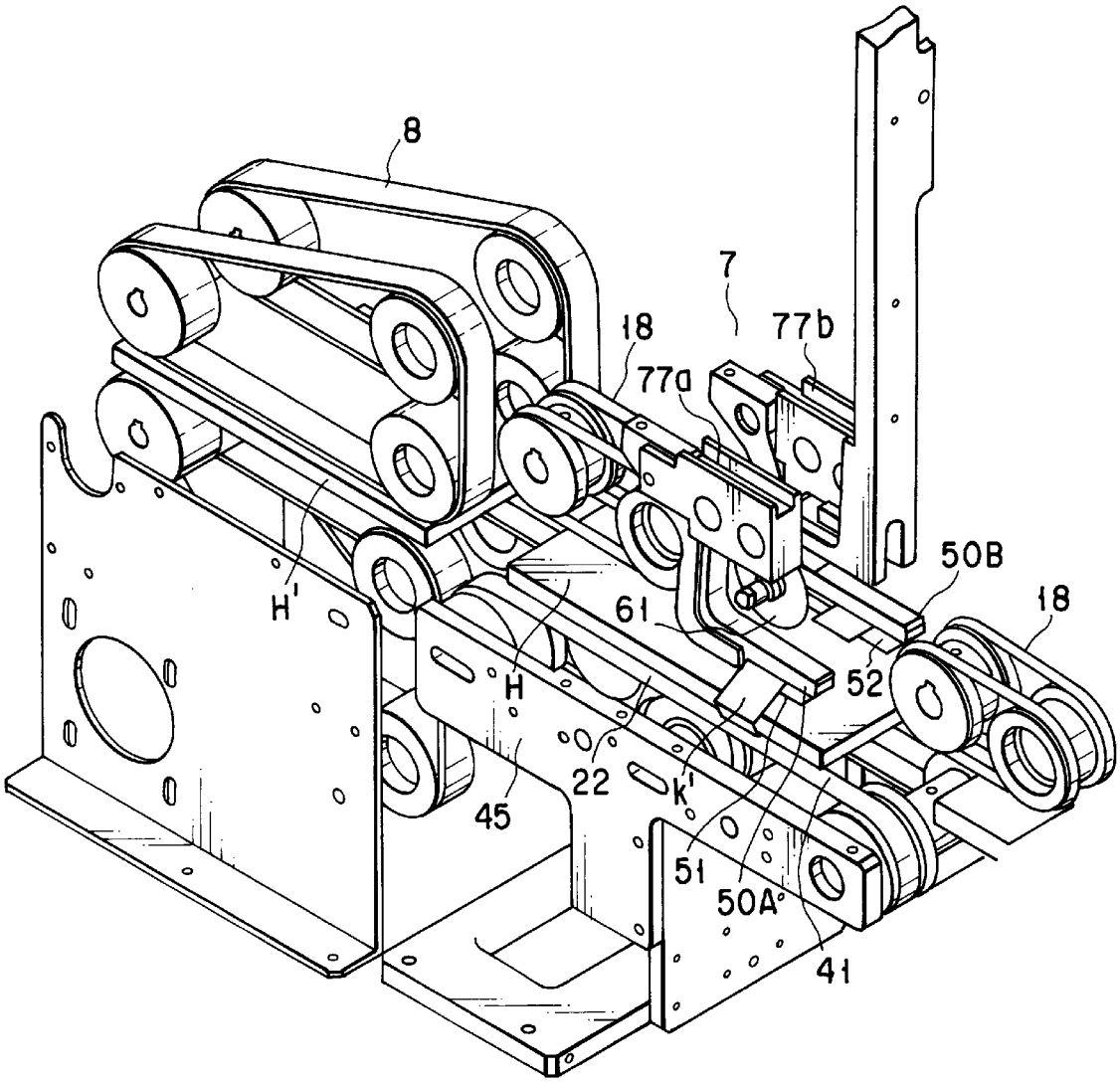
FIG. 3 is a perspective view showing the small strap removing portion.
Figure 4:
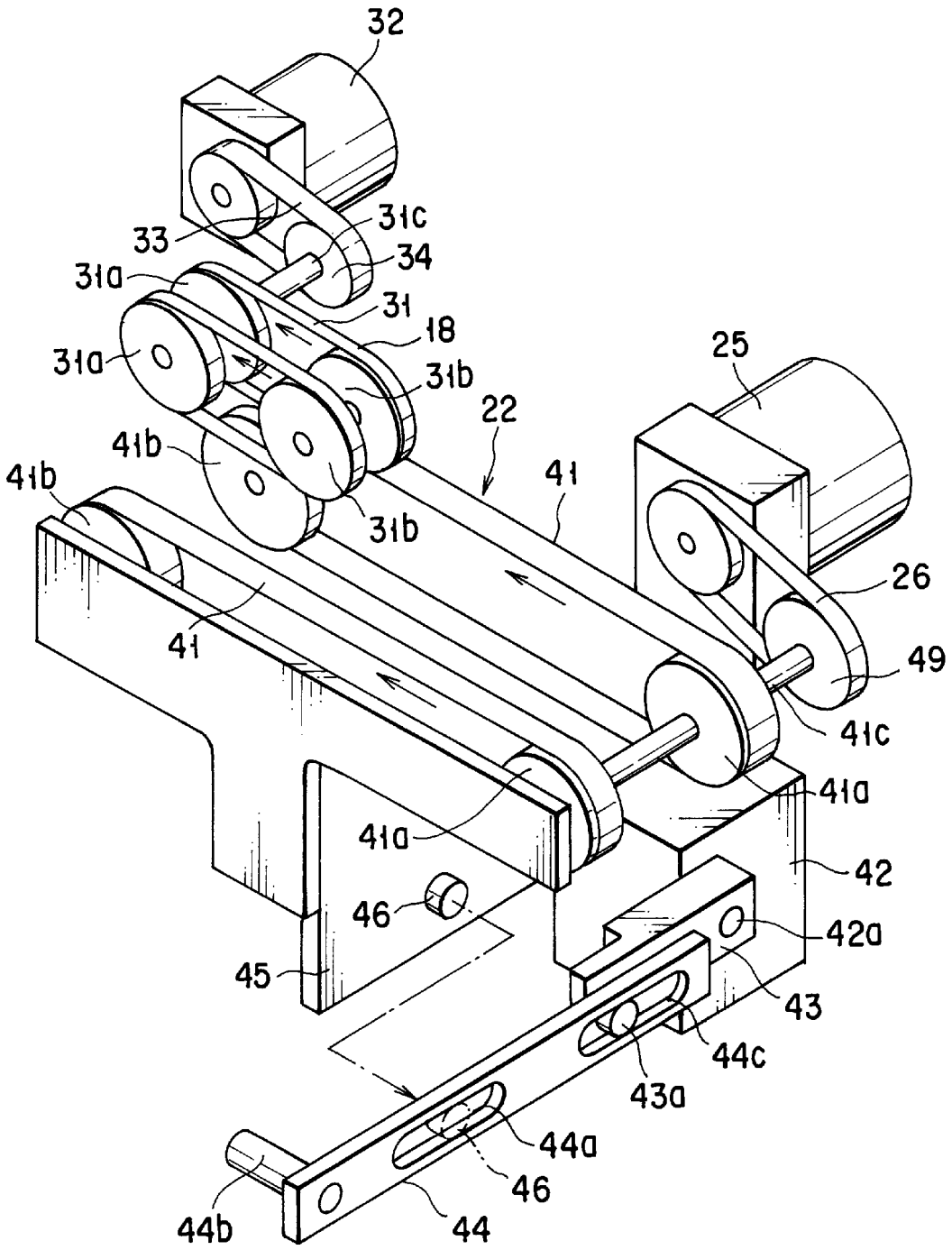
FIG. 4 is a perspective view showing the driving portion of the press conveyer.

FIG. 3 is a perspective view showing the small strap removing portion 7 provided for the bundle carrying portion 6 and FIG. 4 shows the driving portion thereof.

Upper conveyers 18 as a clearance forming device are provided at an upper portion of the second carrying conveyer 22. The second carrying conveyer 22 has press conveyers 41 that are provided in parallel with a predetermined distance maintained between each other. The upper conveyers 18 are disposed between and shifted from the press conveyers 41 such that the conveyers 18 do not face the press conveyers 41.

The press conveyers 41, shown in FIG. 4, are put over pulleys 41*a* and 41*b*. The pulleys 41*a* are connected by a shaft 41*c*. The shaft 41*c* is connected to the driving motor 25 through a driving pulley 49 and a timing belt 26. When the driving motor 25 is driven to rotate, a drive roller 49 is rotated through the timing belt 26 and then the press conveyer belt 41 travels in the direction of the arrow.

Press conveyers 41 are attached to a holder 45 which has a bearing 46 projecting therefrom. A link arm 44 is connected to the bearing 46. The link arm 44 has long holes 44*a* and 44*c* along the lengthwise direction of itself, and the bearing 46 is slidably engaged in the long hole 44*a*. The link arm 44 has an end portion rotatably supported by a support shaft 44*b*, and an arm 43 is connected to the other end. The arm 43 is provided with a protrusion 43*a* on its top end, which is slidably engaged in the long hole 44*c* of the link arm 44. The arm 43 is jointed at its rear end with the motor shaft 42*a* of a driving motor 42 which drives to rotate reciprocally.

When the driving motor 42 is driven to reciprocally revolve, the arm 43 rotates vertically and link arm 44 swings vertically by the rotation about the support shaft 44*b* centered. Accordingly, the holder 45 swings vertically by the bearing 46, and the press conveyers 41 make vertical reciprocal motion.

Meanwhile, the upper conveyers 18 are equipped with conveyer belts 31 arranged in parallel maintaining a predetermined space between each other. Each conveyer belt 31 is put over pulleys 31*a* and 31*b*. The pulleys 31*a* are connected through a shaft 31*c*, and a driving motor 32 is connected to the shaft 31*c* through a drive roller 34 and a timing belt 33.

When the driving motor 32 is driven to revolve, the drive roller 34 is revolved by the timing belt 33, and the upper conveyers travel in the direction of the arrow.

Figure 5:
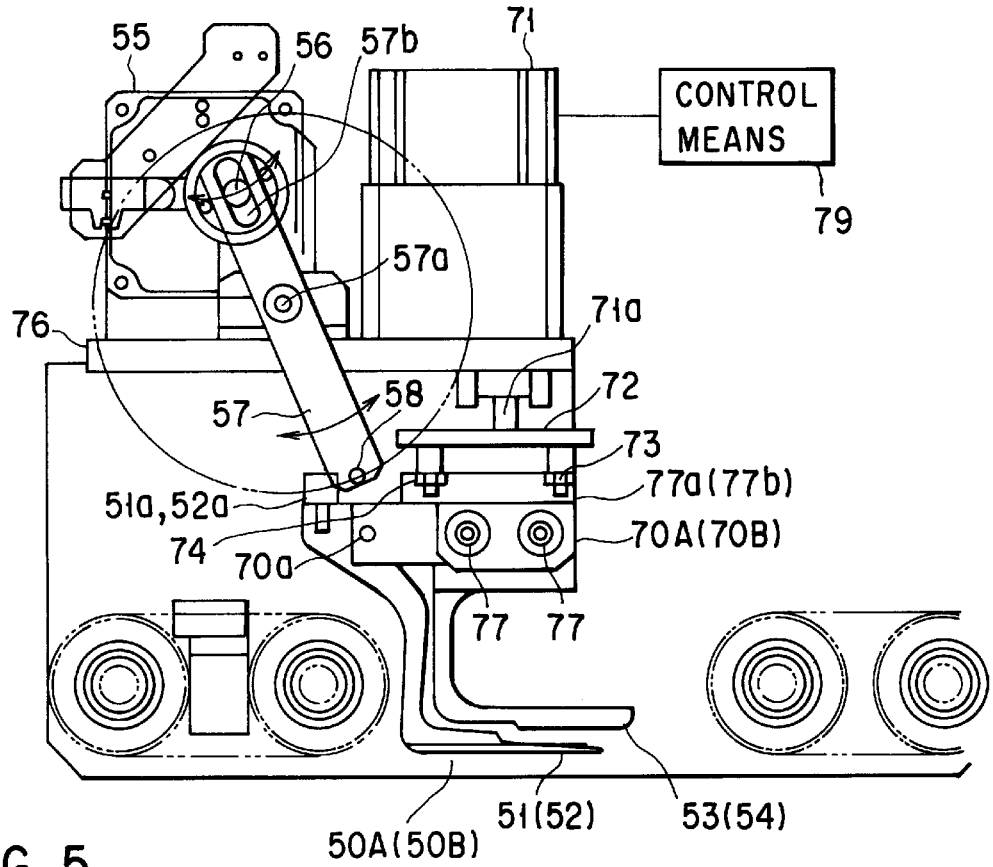
FIG. 5 is a view showing the structure of the driving portion of the sealing strap catcher.

FIG. 5 shows the strap catchers 50A and 50B as a pair of pick-up means.

Strap catchers 50A and 50B have lower arms 51 and 52 and upper arms 53 and 54. The upper arms 53 and 54 are fixed on movable bases 70A and 70B. The lower arms 51 and 52 are attacked to the movable bases 70A and 70B rotatably by a support shaft 70*a*, such that the lower arms are able to open and close with respect to the upper arms 53 and 54. Bearings 51*a* and 52*a* are attached to upper end portions of the lower arms 51 and 52. A pin 58 attached to a lower end of the rotatable arm 57 is arranged so as to contact the bearings 51*a* and 52*a*. The rotatable arm 57 is rotatably supported at its center portion by the support shaft 57*a* and is connected at its upper portion to a driving motor 55 through motor arm 56.

The driving motor 55 is attached to a motor base 76, and a driving motor 71 for sliding is also attached to this motor base 76. An arm 72 is connected to the rotation shaft 71*a* of the driving motor 71, and bearings 73 and 74 are attached to both ends of the arm 72. Movable bases 70A and 70B are supported by guide shafts 77 such that the bases can slide horizontally. On the upper surface portion of the bases, grooves 77*a* are formed along a direction perpendicular to the guide shafts 77. Inside the grooves 77*a*, bearings 73 and 74 are inserted and attached to both ends of the arm 72.

When the driving motor 55 is driven to revolve reciprocally, the arm 56 moves in the arrow direction and the link arm 57 rotates about the support shaft 57*a* centered. When the link arm 57 rotates in the clockwise direction, a pin 58 on its top end contacts the bearings 51*a* and 52*a* of the lower arms 51 and 52 and revolves the lower arms 51 and 52 in a direction in which the arms are closed, about the support shaft 70*a* centered. When the link arm 57 is revolved in the anticlockwise direction, the pin 58 on its top end is moved apart from the bearings 51*a* and 52*a* of the lower arms 51 and 52, which are revolved about the support shaft 70*a* in a direction in which the arms are opened.

When the driving motor 71 for sliding is reciprocally revolved, the arm 72 is also reciprocally revolved so that the strap catchers 50A and 50B are moved in a direction in which the catchers are moved apart from each other via bearing 73 and 74 attached on both ends of the arm 72.

Figure 6:
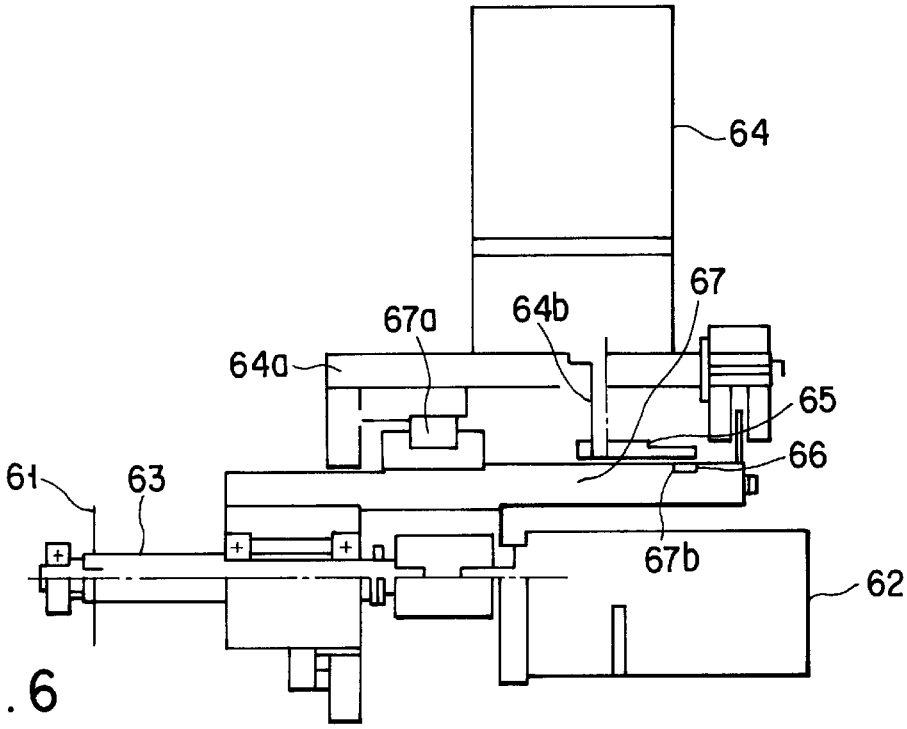
FIG. 6 is a view showing the structure of the driving portion of the sealing strap cutter.

FIG. 6 shows the driving mechanism of the cutter 61 for cutting the small strap k.

The cutter 61 is connected to a driving motor 62 for rotation, via driving shaft 63. The driving motor 62 is attached to a cutter base 67. The cutter base 67 is attached to a motor base 64*a* via slide rail 67*a* such that the base 67 can slide freely. The motor base 64*a* is equipped with a driving motor 64 for sliding. An arm 65 is connected to a shaft 64*b* of the driving motor 64. A bearing 66 is attached on the top of the arm 65 and the bearing 66 is engaged in a groove 67*b* formed in the cutter base 67. When this arm 65 is rotated, the cuter base 67 is moved and the cutter 61 is slid in a direction perpendicular to the small strap k.

Figure 8:
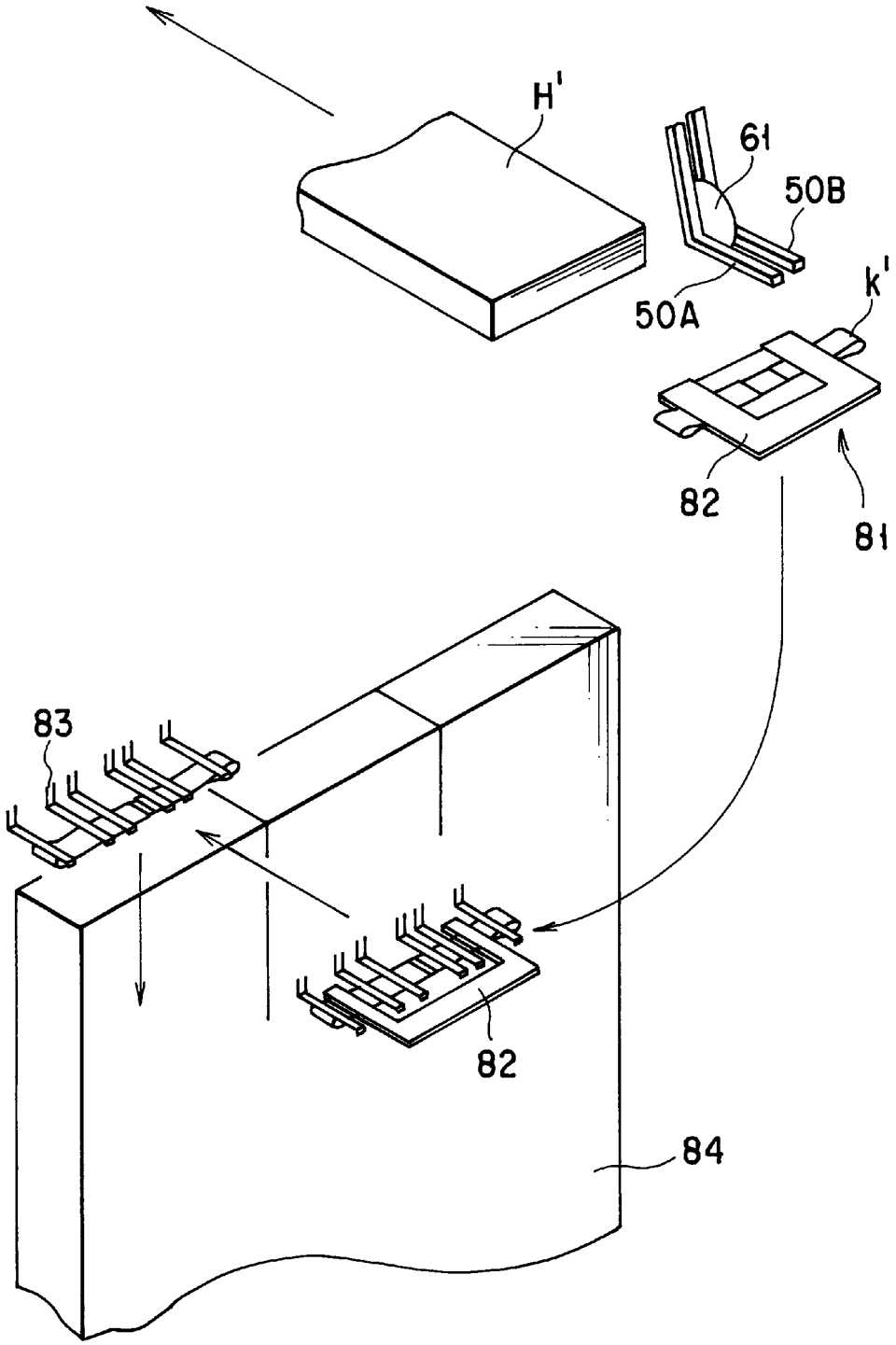
FIG. 8 is a perspective view showing the collecting device which collects a removed small strap.

FIG. 8 is a perspective showing a collecting device 81 for collecting a small strap after being cut.

The collecting device 81 comprises a carrier catch arm 82 as a strap carrier means and serves to receive and carry a small strap k' from strap catchers 50A and 50B by the carrier catch arm 82 and to take in and collect the small strap k' thus carried, from the carrier catch arm 82 into a cassette 84.

Figure 9:
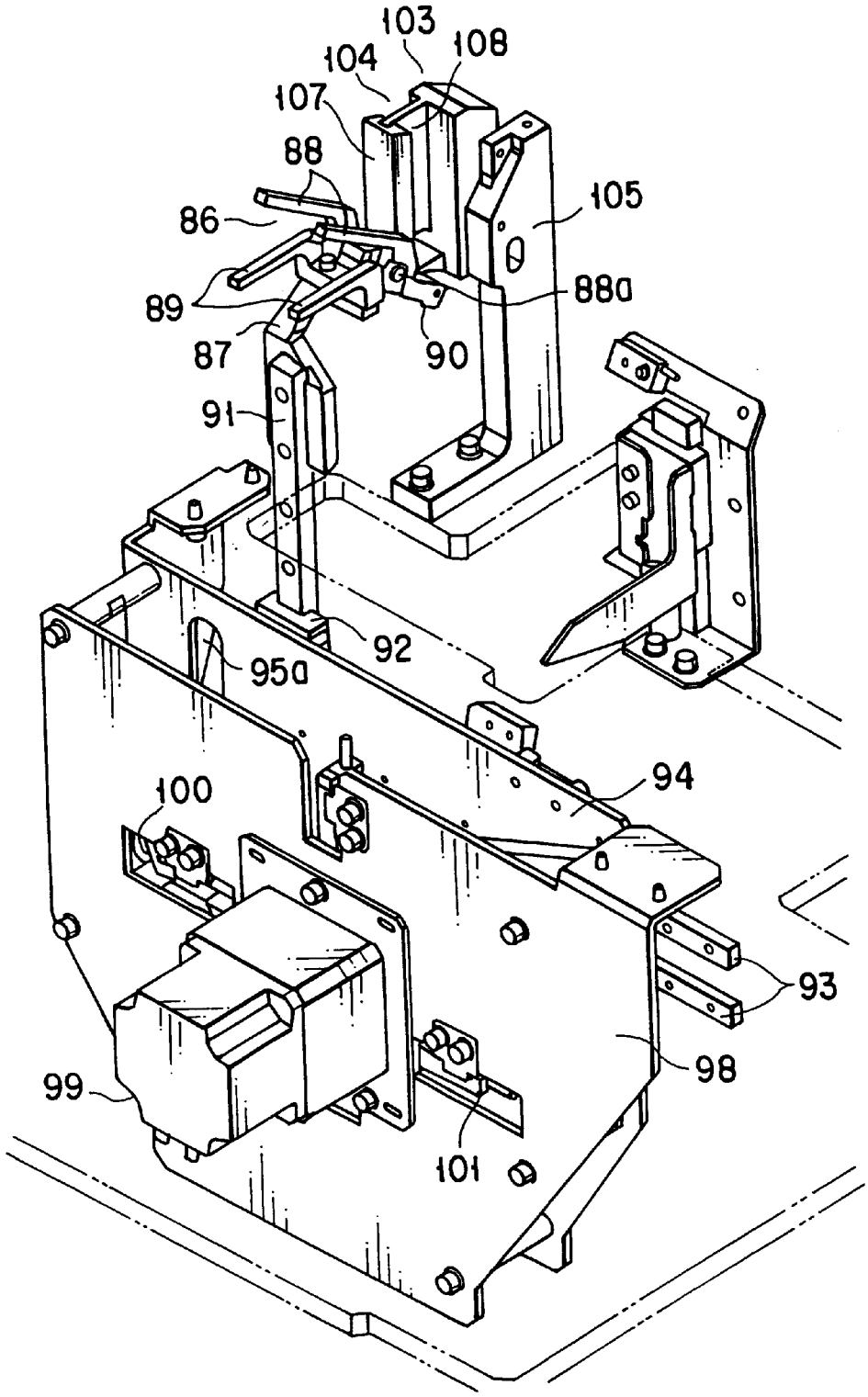
FIG. 9 is a perspective view showing the strap carrying catcher and the driving portion thereof.
Figure 10:
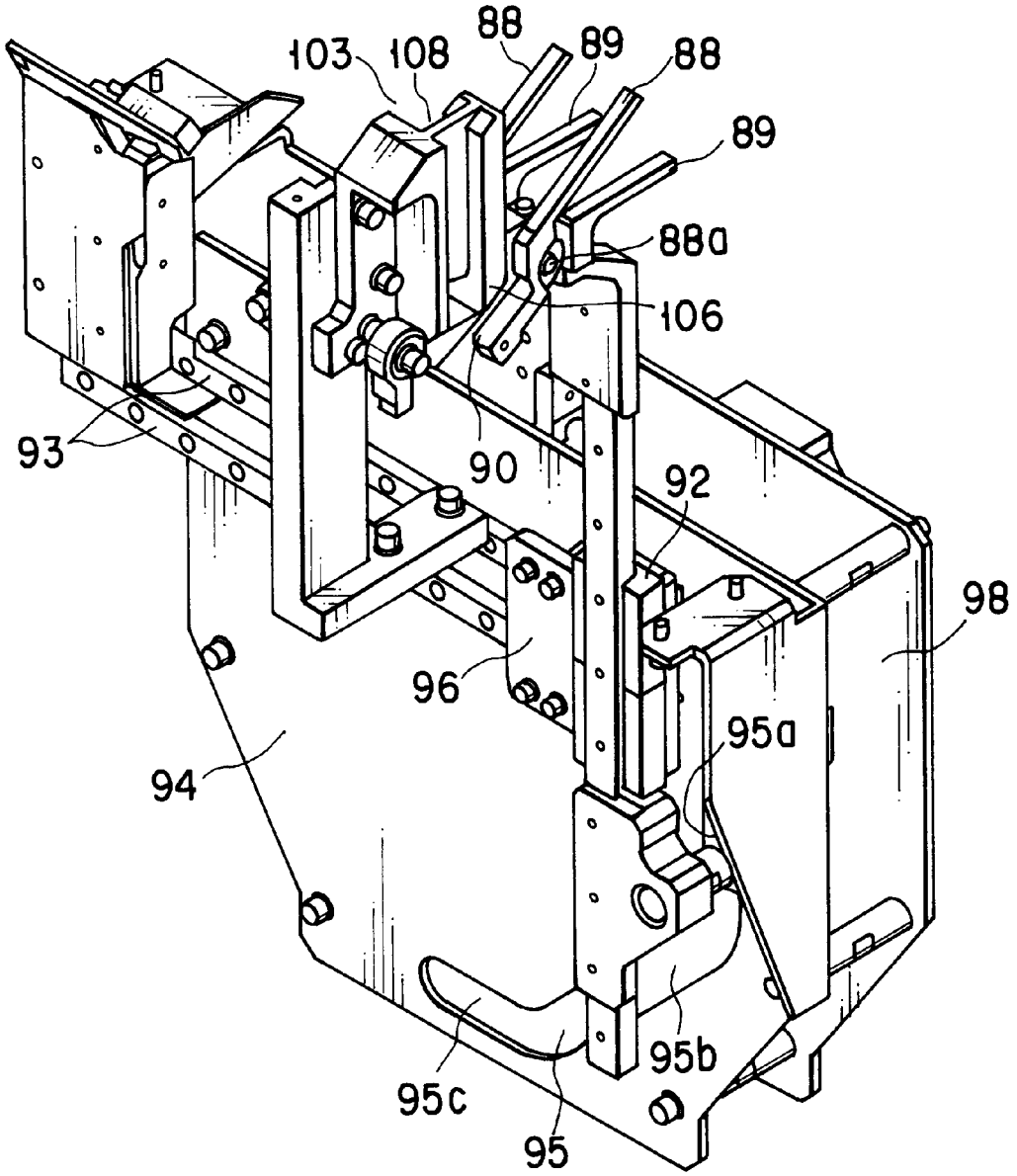
FIG. 10 is also a perspective view showing the strap carrying catcher and the driving portion thereof viewed from a different angle.

FIGS. 9 and 10 show the carrier catch arm 82 and the drive system thereof.

A carrier catch arm 82 consists of a pair of left and right clamping portions 86 which clamp and carry the both end portions of the small strap k' clamped by the strap catchers 50A and 50B. The pair of clamping portions 86 are attached to a mounting bracket 87 and each consist of upper and lower clamping pieces 88 and 89. An intermediate portion of the upper clamping piece 88 is installed on the mounting bracket 87 via the support shaft 88*a* to be rotatable, and a bearing 90 is installed on the back end. The lower clamping piece 89 is fixed on the mounting bracket 87.

The mounting bracket 87 is attached to the top end portion of an operating bar 91 which is guided by a concave guide 92, to be movable vertically. The guide 92 is provided at a slider 96, seen in FIG. 10, and the slider 96 is attached to a first support frame 94 via horizontal guide rails 93.

Shown in FIG. 10, a guide groove 95 is formed in the first support frame 94. The guide groove 95 consists of a vertical portion 95*a*, a slope portion 95*b* continuous to the lower side of the vertical portion 95*a*, and a horizontal portion 95*c* continuous to the lower side of the slope 95*b*. The operation bar 91 is provided with a bearing (not shown) which is slidably engaged in the guide groove 95.

A second support frame 98 is attached to the first support frame 94 so as to face each other with an interval maintained therebetween. The second supporting frame 98 is equipped with a driving motor 99 which rotates reciprocally, seen in FIG. 9. The driving motor 99 is connected with an operation bar 91 via power transmission system (not shown).

When the driving motor 99 rotates reciprocally, the operation bar 91 moves with its bearing vertically and horizontally sliding along the vertical portion 95*a,* slope portion 95*b,* and horizontal portion 95*c* of the guide groove 95. That is, the carrier catch arm 82 attached to the operation bar 91 is reciprocally moved between a receiving position for the small strap k' and a delivery position for a carrier press arm 83.

The second support frame 98 is equipped with a first sensor 100 and a second detecting sensor 101. The first sensor 100 detects if the carrier catch arm 82 reaches the receiving position of the small strap k', and the second detecting sensor 101 detects if the carrier catch arm 82 reaches the delivery position for the press arm 83.

As best seen in FIG. 9, on an obliquely upper portion of the first support frame 94, an open/close portion 103 is attached to open and close the upper clamping pieces 88 of the carrier catch arm 82 in accordance with the vertical motion of the operation bar 91. The open/close portion 103 has a contact block 104 that contacts the bearings 90 of the upper clamping pieces 88, and the contact block 104 is fixed on the upper side of a fixing member 105.

A contact portion 106 is formed on the lower end portion of the contact block 104 to contact the bearings 90 when the upper clamping pieces 88 rise. A guide surface 107 is formed on the front surface side of the block to guide the bearings 90. Further, guide groove portions 108 are formed on the both side portions of the contact block 104 to guide the bearings 90 when the upper clamping pieces 88 move downward.

When the carrier catch arm 82 is moved up, the bearings 90 of the upper clamping pieces 88 are let contact the contact portion 106 of the contact block 104. By this contact, the upper clamping pieces 88 rotate and open their top ends upward about the support shaft 88*a.* Thereafter, the bearings 90 are guided upward along the guide surface 106 of the contact block 104 and the upper clamping pieces 88 maintain themselves opened.

When the opened upper clamping pieces 88 are further moved upward, the bearings 90 come off from the guide surface 106 of the contact block 104. Once the bearings 90 come off, the upper clamping pieces 88 rotate and close their top end portions in a direction in which the top end portions move downward. After the upper clamping pieces 88 are thus closed, the pair of clamping portions 86 are moved down. During the downward motion, the bearings 90 of the upper clamping pieces 88 are inserted and guided by the guide grooves 108 of the contact block 104.

Figure 11:
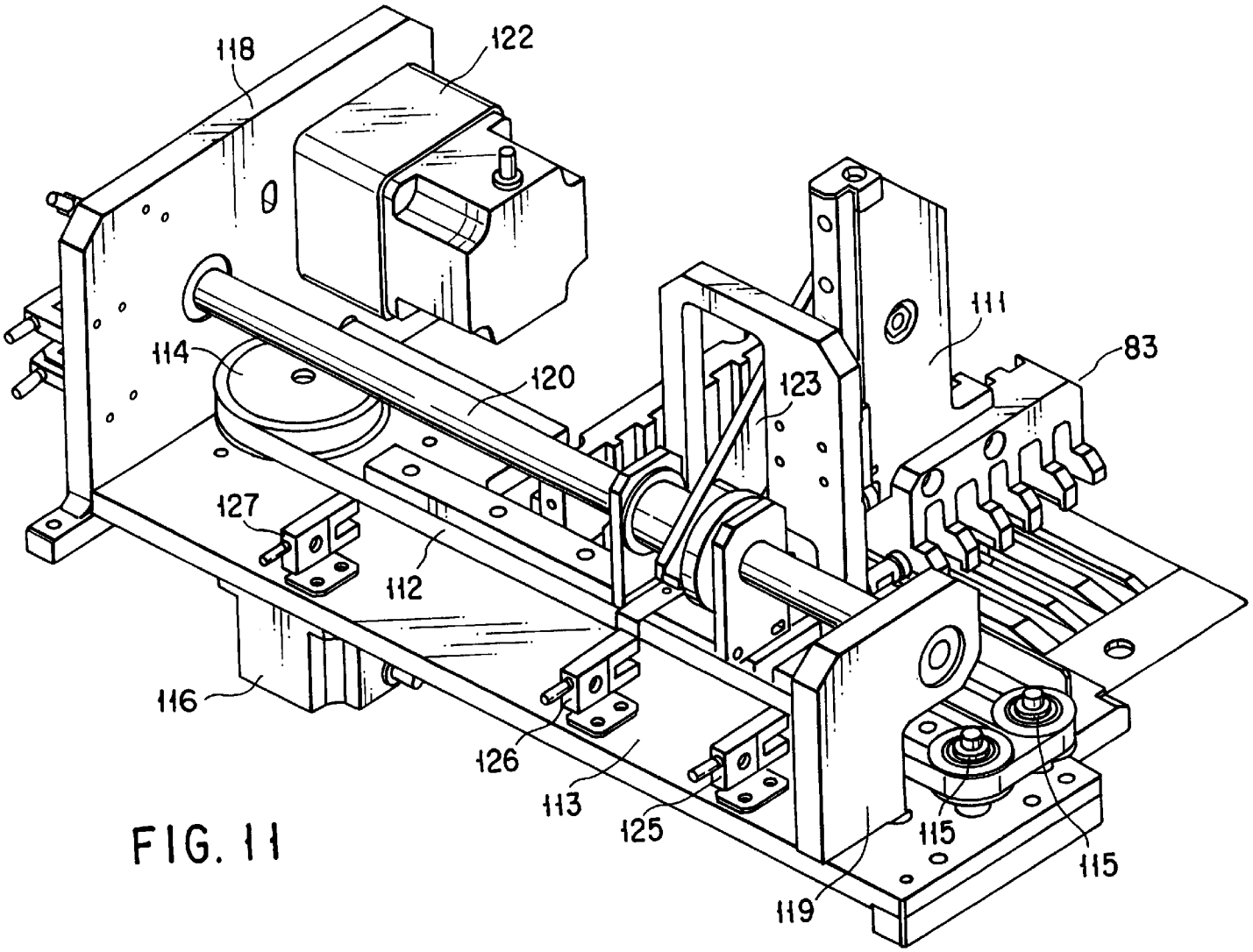
FIG. 11 is a perspective view showing the strap carrying press-arm and the driving portion thereof.

FIG. 11 is a perspective view showing the driving portion of the carrier press arm 83.

The reference 111 in FIG. 11 denotes a slider for installing the carrier press arm 83 to be movable vertically. The slider 111 is arranged so as to slide by the traveling of the timing belt 112. The timing belt 112 is put over a driving pulley 114 and slave pulleys 115 that are attached to a base 113. A driving motor 116 is attached on the lower surface side of the base 113 in order to rotate the driving pulley 114 reciprocally.

Support plates 118 and 119 are attached on both side portions of the base 113. These support plates 118 and 119 rotatably support the both end portions of a spline shaft 120. A driving motor 122 is attached to the support plate 118 to rotate the spline shaft 120 reciprocally. An arm 123 is attached to the spline shaft 120, and the arm 123 rotates in accordance with the rotation of the spline shaft 120 thereby to move the carrier press arm 83 vertically.

First to third sensors 125, 126, and 127 are equipped on the upper surface portion of the base 111 along the moving direction of the press arm 83. The first sensor 125 detects a pick-up position of the small strap k'. The second sensor 126 detects the initial position of the carrier press arm 83. The third sensor 127 detects a pushing position of the small strap k' toward cassette 84.

Figure 12:
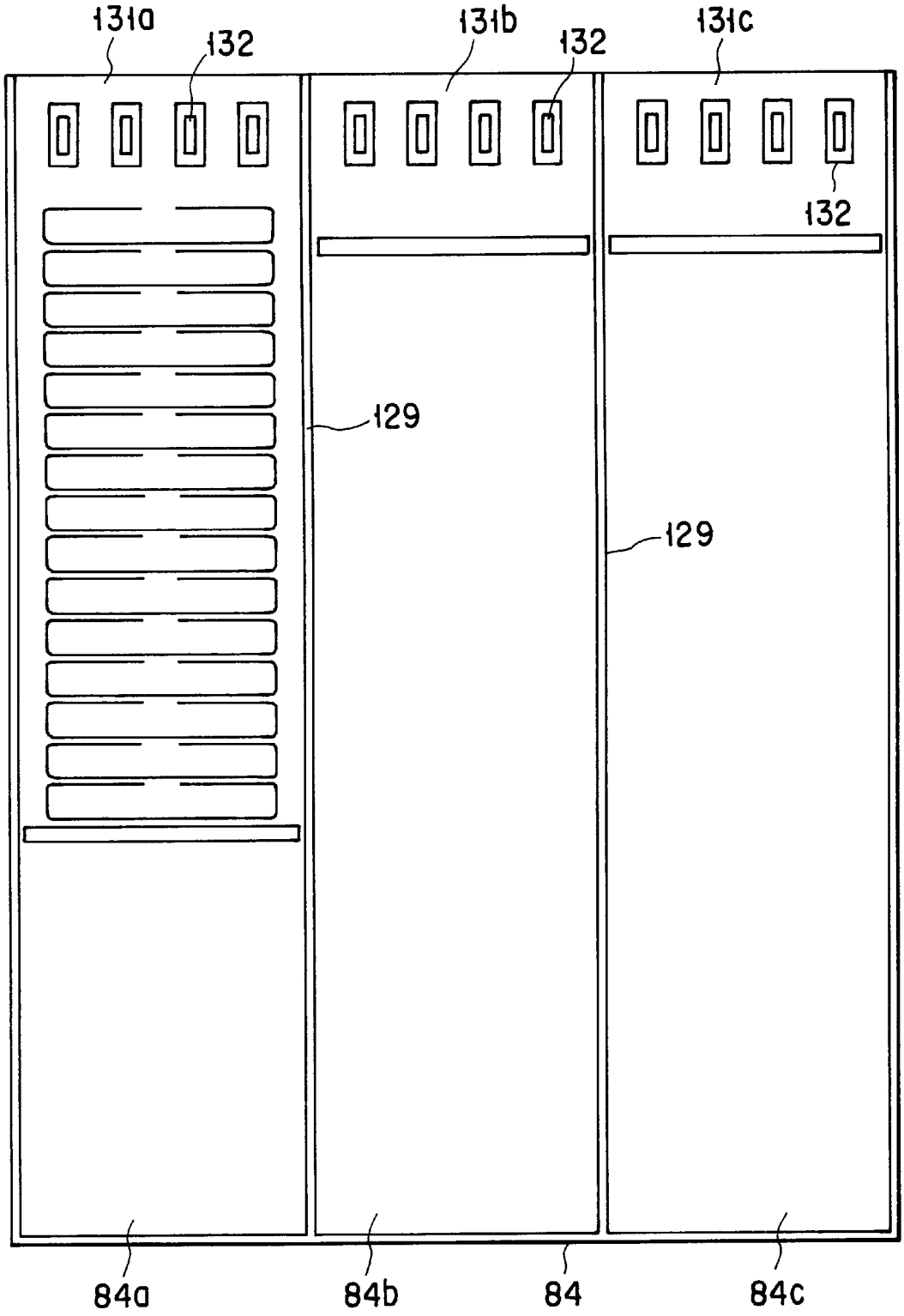
FIG. 12 shows the cassette for storing the small straps.

FIG. 12 shows a cassette 84.

The inside of the cassette 84 is partitioned into three rooms 84*a,* 84*b,* and 84*c* by partition boards 129. The upper surface opening portions of the three rooms 84*a,* 84*b,* and 84*c* are opened and closed by upper covers 131*a,* 131*b,* and 131*c.* Nail portions 132 are formed on the upper covers 131*a* 131*b,* and 131*c* to be nested with the carrier press arm 83. A mounting plate 133 for mounting small straps k' is provided in the cassette 84 such that the plate 133 is movable vertically.

The cassette 84 thus constructed is arranged to be movable in a direction perpendicular to the moving direction of the carrier press arm 83 and can let the rooms 84*a,* 84*b,* and 84*c* selectively face the carrier press arm 83.

Figure 20:
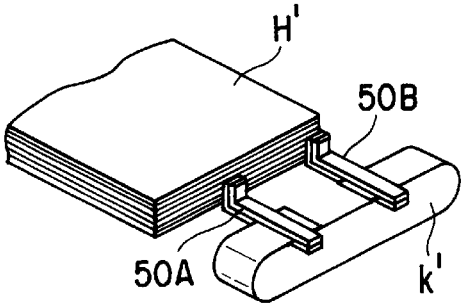
FIG. 20 is a perspective view showing the small strap removed out from the valuable papers.
Figure 21:
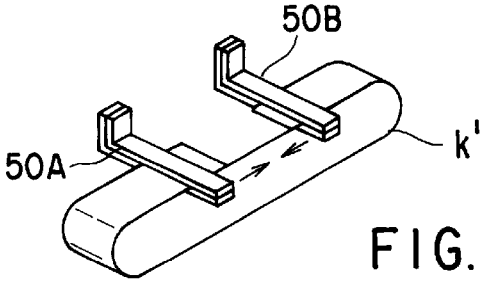
FIG. 21 shows the pair of the strap catchers returned to the initial position after removal of the small strap.
Figure 22:
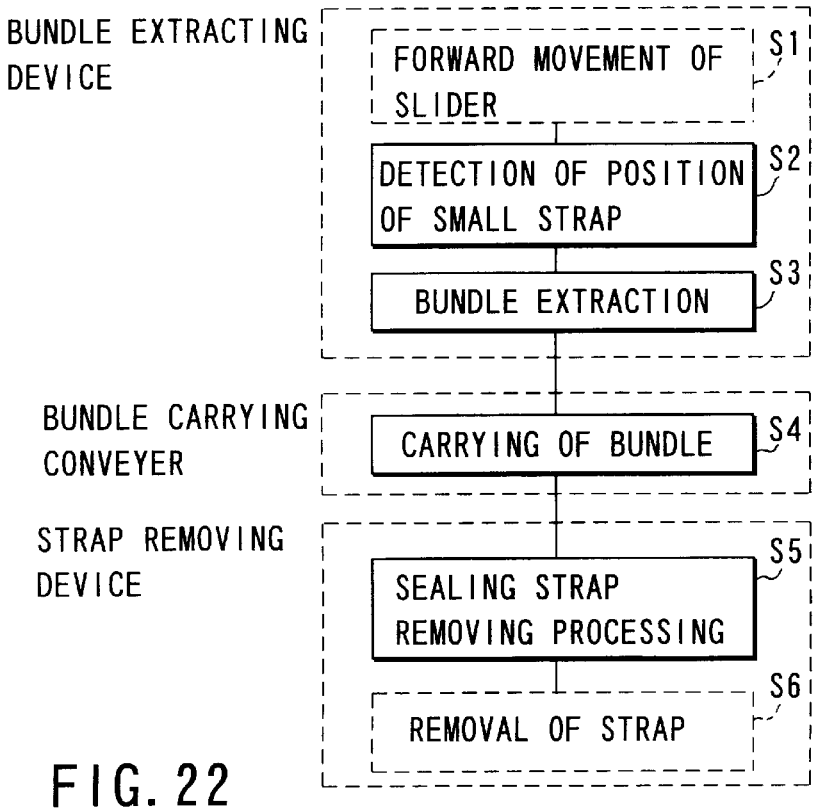
FIG. 22 is a flow chart showing the operation of removing small strap.
Figure 23:
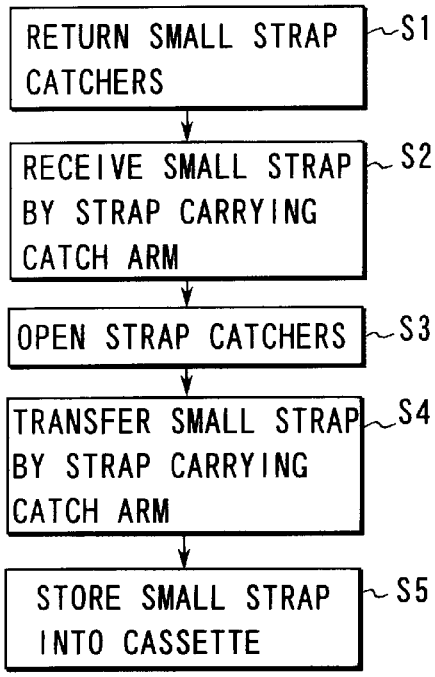
FIG. 23 is a flow chart showing the operation of collecting the small strap.

Next, the operation of treating the small straps k will be explained, with reference to operation views shown in FIGS. 1, 2, and 13 to 21, and in flow charts shown in FIGS. 22 and 23.

Figure 7:
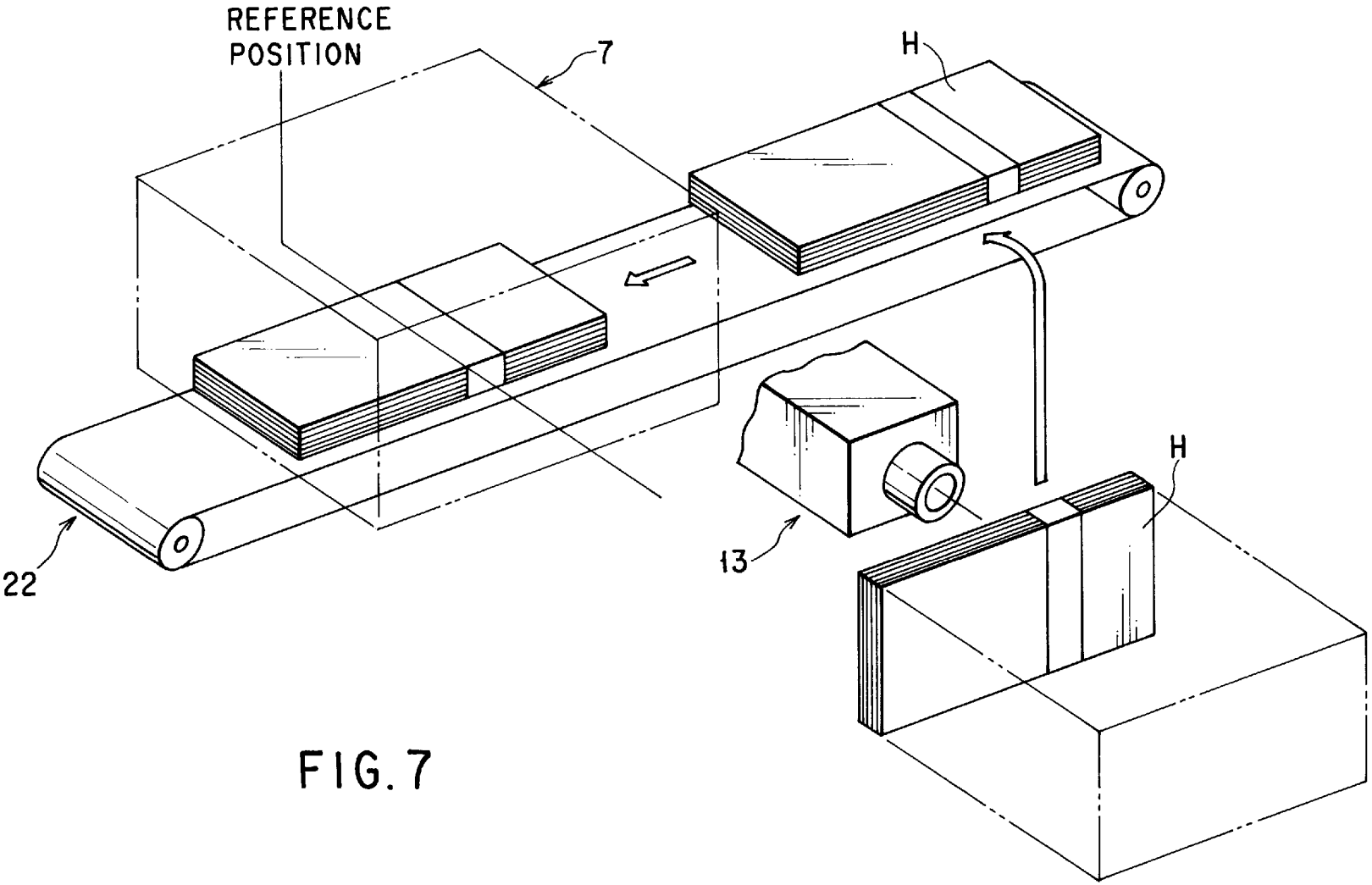
FIG. 7 is a perspective view showing the position checking device for a small strap.

Firstly, as shown in FIG. 1, when a unsealed sheaf T' is sent to the bundle pick-up portion 5 by the unsealed-sheaf carrier portion 4, the driving motor 14 for sliding shown in FIG. 2 is rotated. In accordance with this rotation, the slider 10 is moved forward by the timing belt 15 and an attachment not shown (step S1 in FIG. 22). The driving motor 14 stops driving when the unsealed sheaf T' is carried in accordance with the forward movement of the slider 10 to reach a predetermined position and is detected by a sheaf detecting sensor (not shown). The unsealed sheaf T' is sandwiched between the slider 10 and an inner belt 11. At this time, a camera 13 shown in FIG. 7 for detecting small straps detects the position of the small strap k of the first bundle H of the unsealed sheaf T' by means of image processing (step S2). Thereafter, the driving motor 16 for extraction is started to drive and the inner belt 11 travels. In this manner, the bundle H is extracted and clamped between the inside belt 11 and the outside belt 12 and is carried upward (step S3). After the bundle H reaches the uppermost end by the extraction described above, the bundle is transferred to a predetermined position on the first conveyer 21, guided by a roll guide 17.

Thereafter, the driving motor 23 is started to drive and the first conveyer 21 travels via timing belt 24. In this manner, the bundle H is carried to a reference position in the lengthwise direction. From this position as the starting point of carrying, the bundle H is carried by rotating the first conveyer and further by the second conveyer 22 which is rotated via timing belt 26 (step S4) by starting up the driving motor 25 (step S4). In this time, the controlling portion 28 controls the carrying amount of the bundle H based on strap-position information obtained from the camera 13 for detecting the position of the small strap, such that the small strap k is situated at the predetermined position in the cutting/removing portion 7.

Figure 13:
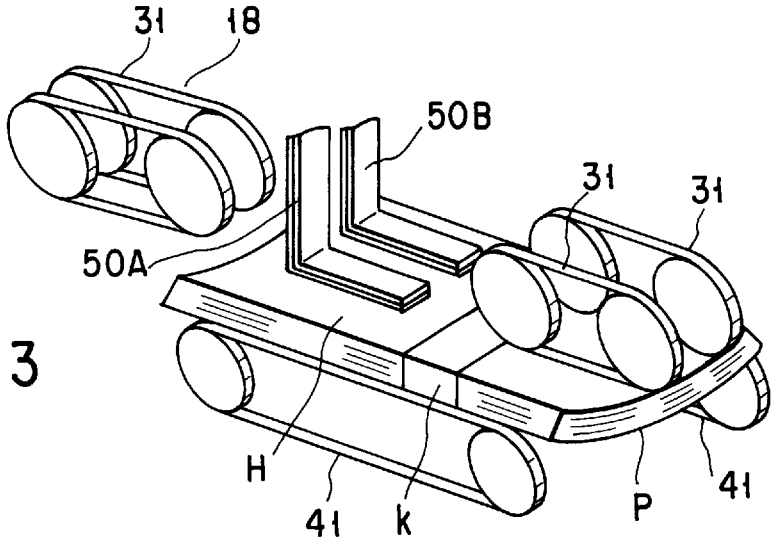
FIG. 13 shows the operation of curving.
Figure 14:
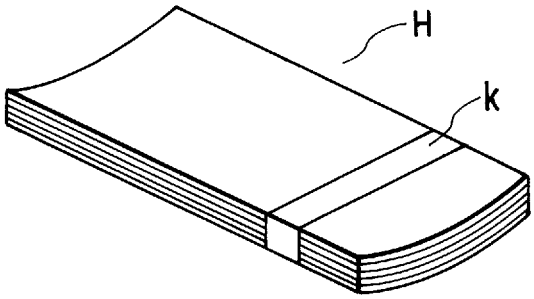
FIG. 14 is a perspective view showing the curved bundle.

The bundle H once carried to the predetermined position by the second carrier conveyer 22, is paused. After the pause, the press conveyers 41 of the second carrier conveyer 22 are moved up, as shown in FIG. 13. As a result of this, both side portions of the bundle H are pushed up and the center portion of the bundle H is pushed against the conveyer belts 31 of the upper conveyer 18, so that the bundle is bent and deformed. In this time, those portions of the upper conveyer belts 31 and the lower press conveyers 41 that clamp the valuable papers P are limited to those portions that avoid the small strap k. That is, since the conveyer belts 31 are situated avoiding the area of the small strap, the small strap k is lifted up from the upper surface of the bundle H. The bundle H thus bent and deformed is clamped between the conveyer belts 31 and the press conveyers 41 and is further carried maintaining this situation.

Figure 15:
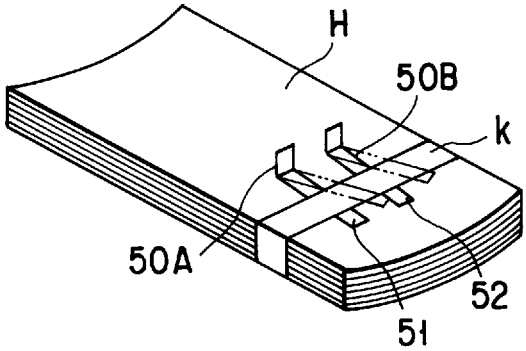
FIG. 15 is a perspective view showing the strap catcher inserted between the curved bundle and the small strap.
Figure 16:
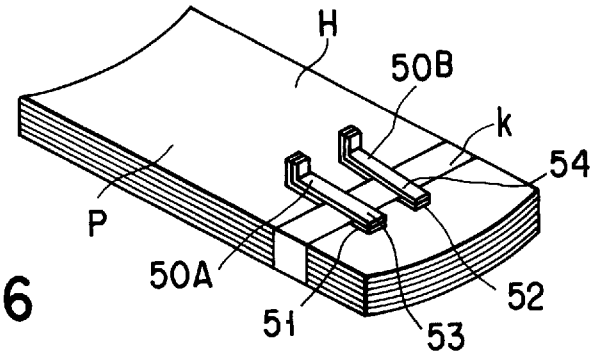
FIG. 16 is a perspective view showing the strap catcher closed and clamping the small strap of the bundle.
Figure 17:
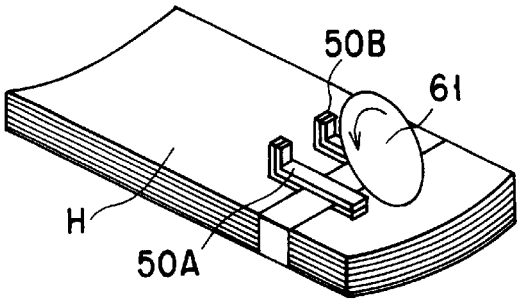
FIG. 17 is a perspective view showing a state where the small strap clamped by the strap catcher is cut off by the cutter.
Figure 18:
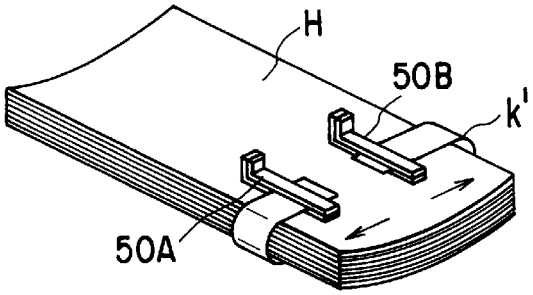
FIG. 18 is a perspective view showing a state where the pair of the strap catchers move to separate from each other direction.
Figure 19:
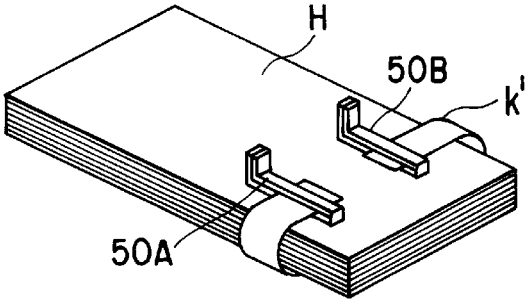
FIG. 19 is a perspective view showing a state where the strap catchers are shifted and loosen the small strap and the bundle becomes horizontal.

In this time, the lower arm portions 51 and 52 of the strap catchers 50A and 50B are rotated and opened downward, as shown in FIG. 15, and are inserted into a clearance between the upper surface of the bundle H and the small strap k thus carried. After the lower arm portions 51 and 52 are thus inserted, carrying of the bundle H is stopped as shown in FIG. 16, and the lower arm portions 51 and 52 are rotated upward and closed so that the small strap k is clamped between the upper arm portions 53 and 54 and the lower arm portions 51 and 52. Thereafter, the cutter 61 is rotated as shown in FIG. 17 and is moved in the direction perpendicular to the small strap k, thereby to cut the strap k (step S5). After this cut, the strap catchers 50A and 50B are moved in a direction in which the catchers are moved apart from each other, so that the small strap k' is loosened as shown in FIG. 19. Thereafter, the bundle press conveyer belts 41 are elevated down by a defined amount to release the bent situation of the bundle H. The bundle H thus released and kept horizontal is clamped and carried by the upper conveyer belts 31 and the press conveyer belts 41. In this manner, the bundle is extracted out of the cut-out small strap k', as shown in FIG. 20, and is completely separated from the small strap k', as a unsealed bundle H' (step S6). After the small strap k' is removed, the strap catchers 50A and 50B are moved in a direction in which the catchers come close to each other with clamping the small strap k', as shown in FIG. 21, thereby to recover the sealed state of the strap k' as before (step S1 in FIG. 23). This movement of the strap catchers 50A and 50B is achieved by controlling the driving of the drive motor 71 by means of a control means 79. The small strap k' which has recovered its sealed state is received with both end portions clamped by the carrier catch 82 (step S2 in FIG. 23). Thereafter, the strap catchers 50A and 50B are opened (step S3 in FIG. 23). After the opening, the carrier catch arm 28 is moved downward to carry to the small strap k' to a delivery position close to the cassette 84. Thereafter, the carrier press arm 83 is moved forward to scratch out the small strap k' from the carrier catch arm 82 and moves to above the opening portion of the upper surface of the cassette 84 (step S4 in FIG. 23). At this time, the upper cover 131 of the cassette 84 is opened and the carrier press arm 83 is moved down into the cassette 84, thereby pushing in the small strap k'. After the carrier press arm 83 is thus moved down into the cassette 84, the upper cover 131 is closed and the carrier press arm 83 is moved upward from this state and is extracted from the cassette 84. Storage of the small strap k' is thus completed (step S5 in FIG. 23).

Meanwhile, the unsealed bundle H' from which the small strap k is removed is carried to an unsealed-bundle discharge device, kept clamped, and is discharged to the valuable paper supply/pick-up device.

Figure 24:
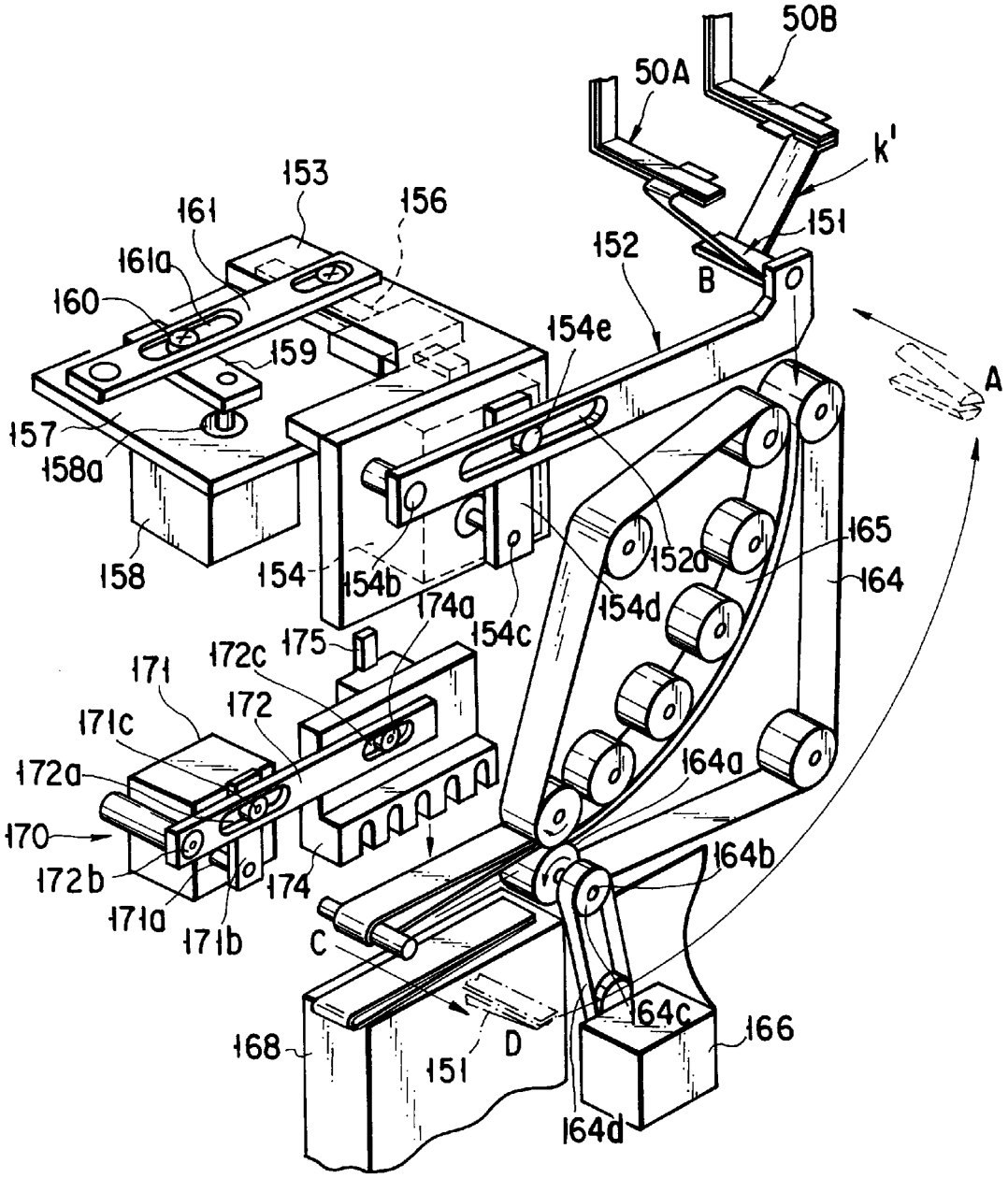
FIG. 24 is a perspective view showing another practical form of a small strap collecting device.

FIG. 24 shows another collecting device for cutting a sealing strap k'.

This collecting device has a carrying pin as will be set out below. That is, the unsealed bundle H' is pulled away from the sealing strap k as shown in FIG. 20, the portions of the resultant sealing strap are clamped, by strap catchers 50A, 50B as shown in FIG. 21, in a spread-apart state and the carrying pin 151 downwardly pushes the portions of the spread-apart strap. The pin 151 is projected at the end of the rotation arm 152. The rotation arm 152 is rotatably mounted by a support shaft 154*b* to a rotation unit 153. A drive motor 154 is mounted to the rotation unit 153. To its drive shaft 154*c* the rotation arm 152 is connected, at its elongated hole 152*a*, through an arm 154*d* and pin 154*e*. The rotation unit 153 is slidably mounted to a base 157 through a slide rail 156. A drive motor 158 is mounted on the base 157. To its shaft 158*a* a ring arm 161 is connected, at its elongated hole 161*a*, through an arm 159 and pin 160.

Below the rotation arm 152 carrying conveyers 164, 165 are arranged to allow a sealing strap k' to be carried therebetween. Carrying conveyer 164 is driven by drive pulley 164*a*, which in turn is connected to drive motor 166 through a shaft 164*b*, pulley 164*c* and drive belt 164*d*, shown in FIG. 24.

A storage box 168 is provided on a discharge side of the carrying conveyors 164, 165 and a push-in mechanism 170 is arranged above the storage box 168 to allow the sealing strap k' to be pushed into the storage box 168. The push-in mechanism 170 is equipped with a drive motor 171. A press link arm 172 is connected, at its elongated hole 172*a*, to a drive shaft 171*a* of the motor 171 through an arm 171*b* and pin 171*c*. The press link arm 172 is rotatably supported, at its one end side, by a support shaft 172*b* and has an elongated hole 172*c* provided at the other end side. The press link arm 172 is connected, at its elongated hole 172*c*, to a storage press 174 through a pin 174*a*. The storage press 174 is so supported as to be movable in an up/down direction.

Figure 25:
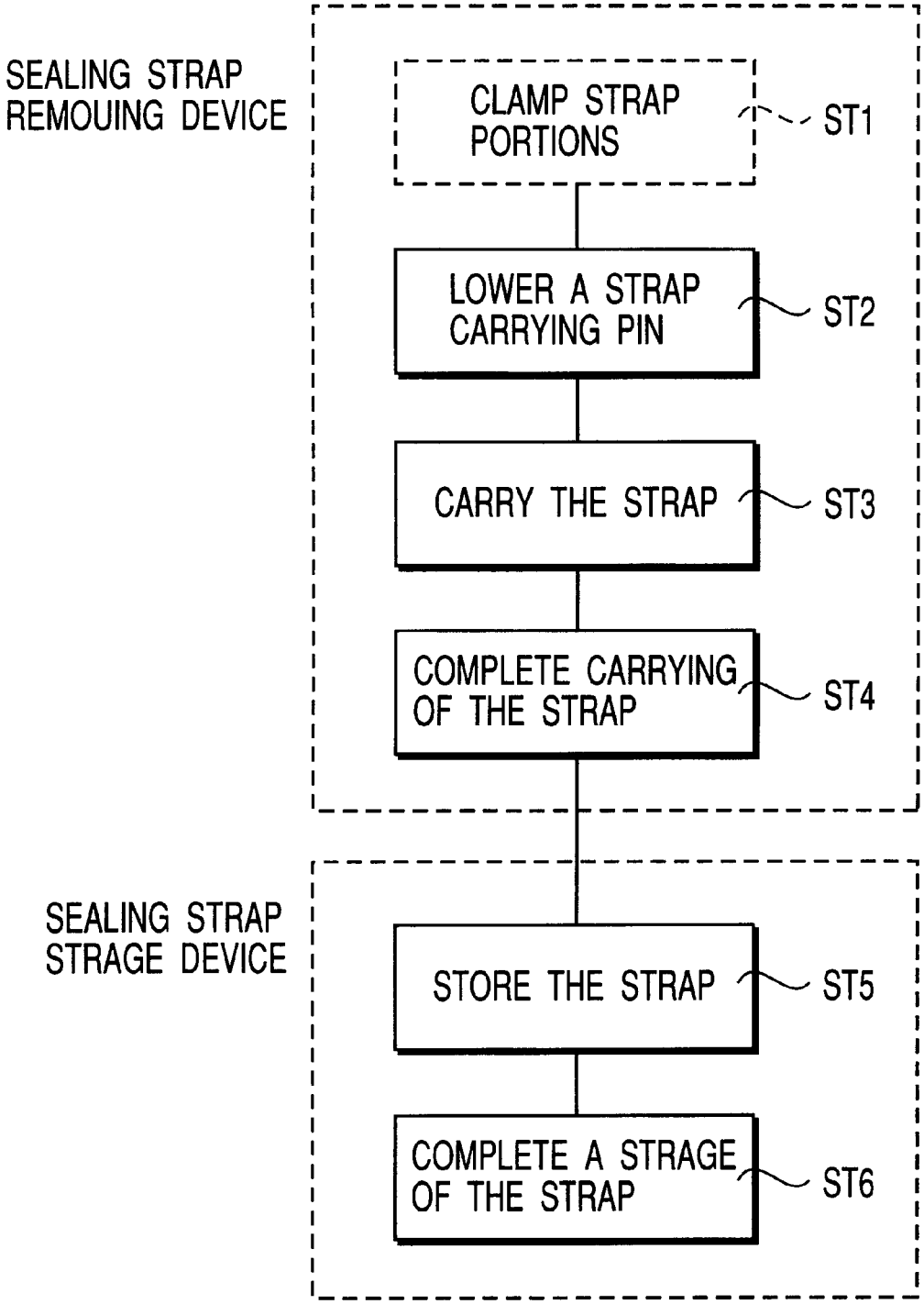
FIG. 25 is a flow chart showing a small strap collection operation.

Then, the collection operation of the cut sealing strap k' will be explained below with reference to a flow chart as shown in FIG. 25.

From a state in which the sealing strap carrying pin 151 is located at a position A, the motor 158 for carrying pin slide is driven to allow its rotational drive force to be converted by the link arm 161 to a direct motion. By doing so, the rotation unit 153 is moved along a slide rail 156 and the sealing strap carrying pin 151 is moved from the position A to a position B to cause a central portion of the sealing strap k' to be gripped by its forward end portion-shift section (step ST1). Then the drive motor 154 for carrying pin rotation is started, causing the rotational drive to be transmitted by the arm 154*d* to the sealing strap rotation arm 152, so that the rotation arm 152 and hence the carrying pin 151 are lowered (step ST2). Further, the drive motor 166 for carrying conveyer drive is started, thus rotating the sealing strap carrying conveyors 164, 165 through a drive timing belt 164*d* (step ST3) and synchronously carrying the sealing strap k' to a position C with the sealing strap k' sandwiched by the carrying pin 86.

When, in this way, the sealing strap k' is carried to the position C (step ST4), the drive motor 158 for carrying pin slide is driven to cause the carrying pin 151 to be removed from the sealing strap k' in a position D direction. Then, the drive motor 171 for sealing strap storage press is started, causing a rotational drive to be converted by the press link arm 172 to a direct motion and the sealing strap storage press 103 to be moved downwardly along the press slide rail 175 (step ST5). By doing so, the sealing strap k' is pressed into the storage cassette 168, completing a storage operation (step ST6).

Figure 26:
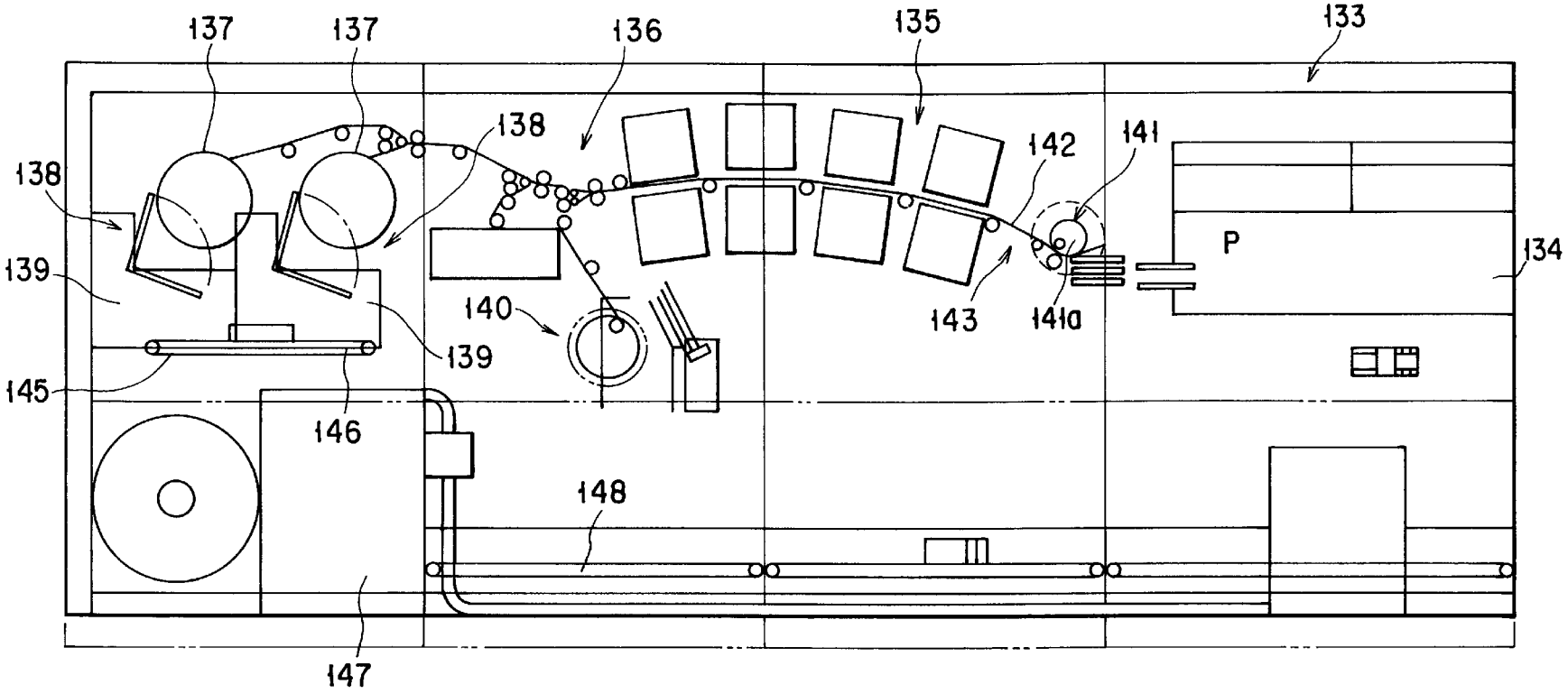
FIG. 26 is a view schematically showing the whole processing apparatus for the valuable papers.
Figure 27:
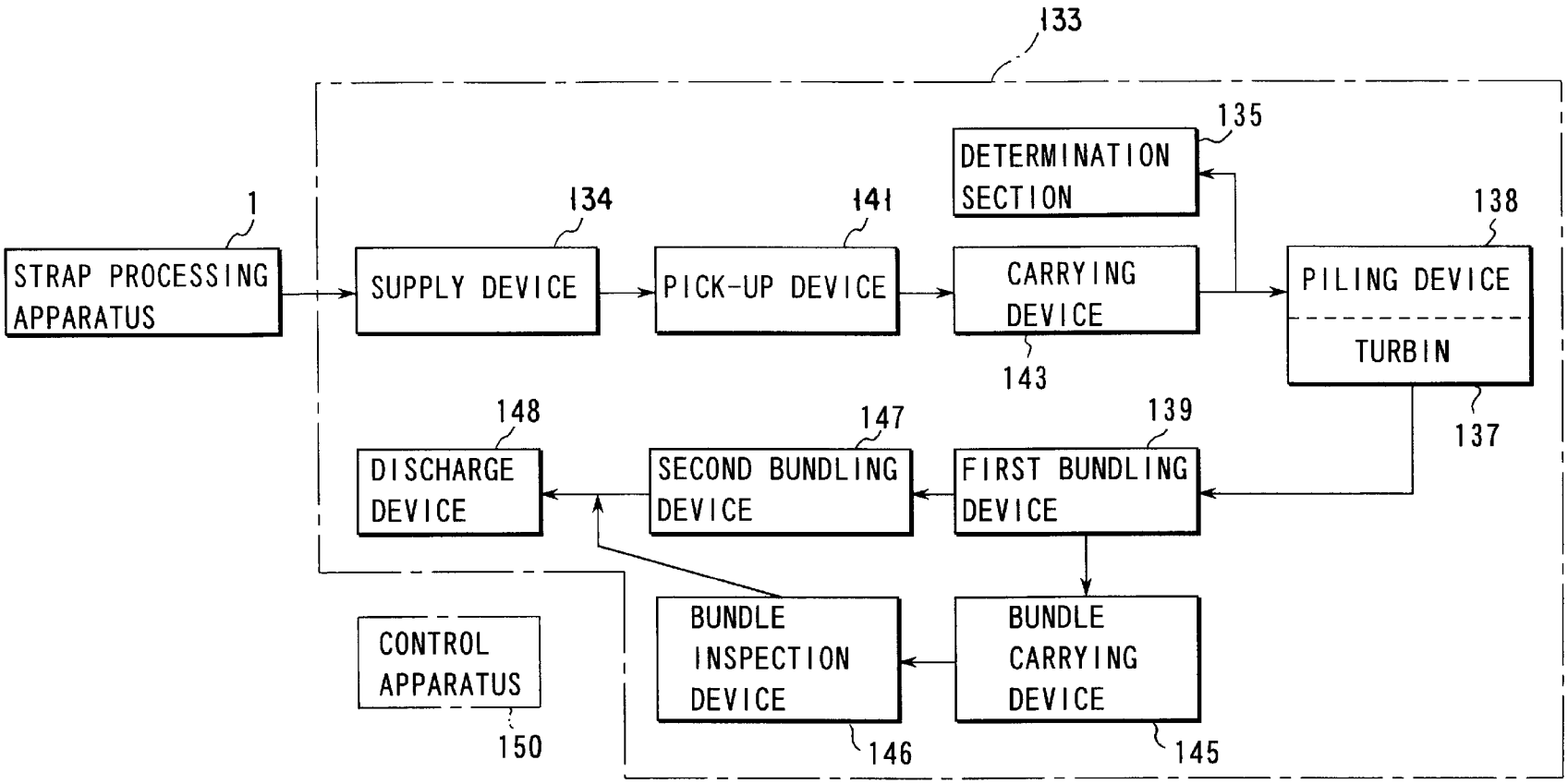
FIG. 27 is a block diagram schematically showing the structure of the valuable paper processing apparatus.

FIG. 26 schematically shows the entire structure of the processing apparatus 133 for valuable papers. FIG. 27 is a block diagram thereof.

The processing apparatus 133 for valuable papers picks up one after another of valuable papers from the unsealed bundle H' carried by the unsealed-bundle carrying portion 8 of the strap processing apparatus 1. After making inspection and calculation, the apparatus 133 layers and seals the papers for every predetermined number of sheets, e.g., for every hundred sheets, in form of a bundle by a strap-like member. Further, the apparatus 133 seals a plurality of bundles each sealing valuable papers, for example, for every ten bundles.

The processing apparatus 133 is arranged so as to deal with valuable papers in units each consisting of a plurality of valuable papers, e.g., thousand valuable papers. At the right end portion of the processing apparatus, a supply device 12 is provided as a supply means which automatically and sequentially sets 1000 sheets of layered valuable papers at once.

The processing apparatus 133 comprises a pick-up section 141 as a pick-up means for extracting one after another of valuable papers set in, a carrying device 142 as a carrying means for carrying the extracted valuable papers along a predetermined carrying passage 143, a determination section as a determination means 135 for detecting information such as a pattern, size, and carrying pitch from the valuable papers being carried, a distributing portion 136 for distributing the valuable papers in carrying directions in accordance with the detection result, a piling device 138 having an impeller for piling the valuable papers distributed, a first bundling device 139 for bundling the piled valuable papers with use of strap-like members having a heat-melting characteristic, and a voiding portion 140 for cutting out and storing valuable papers to be voided.

The pick-up section 141 comprises an adsorptive roller 141*a* which picks up and delivers one after another of valuable papers P from the supply device 134 to the carrying device 142. The carrying device 142 comprises a plurality of carrier belts, drive pulleys, drive motors, and the like provided along a predetermined carrying passage 143.

The determination portion comprises a layering detecting portion for detecting extracted papers layered during carrying, a reading device for reading a pattern drawn on a valuable paper P, a counting device for counting the number of valuable papers P, and the like. These devices are provided orderly along the carrying passage 143.

The Valuable papers subjected to counting operation, pattern-reading operation, and length-detection in the determination portion 135 are divided into a plurality of kinds of papers in accordance with the detection result, e.g., two kinds of valuable papers and a kind of void papers. The valuable papers are fed to the piling device 138 or the voiding portion 140 depending on the kind of papers.

The first bundling portion 139 is connected to the piling device 138 and serves to wrap a strap-like member (or small strap) around layered hundred valuable papers by one turn. Thereafter, the portion 139 bundles the papers by heat-pressing both end portions of the strap-like member against each other, forming a bundle.

Two sets of piling devices 138 and first bundling devices 139 are provided in compliance with the kinds of the valuable papers. Below the first bundling devices 139, there are provided a bundle conveyer device 145 for carrying bundles and a bundle inspection device 146 for inspecting bundles. The bundle is carried to a second bundling device 147 through the bundle inspection portion 146 by the bundle carrying device 145. Every predetermined number of bundles, e.g., every ten bundles are bundled with use of two strap-like members (or large straps) to be wrapped in form of a cross-shape, and are thereafter discharged to a predetermined portion by the discharge device 148 having a plurality of conveyers.

Further, the entire operation of the processing apparatus 133 is controlled by a control device which functions as a control means 150.

As has been described above, according to the present invention, layered valuable papers are bent to form a clearance between the upper surface of the layered valuable papers and the small strap k, and a pair of strap catchers 50A and 50B clamps the portion of the small strap that is lifted apart from the upper surface of the papers with use of the clearance formed. An intermediate portion of the portion of the strap clamped by the pair of strap catchers 50A and 50B is cut by a cutter 61. Therefore, the small strap k can be cut without contacting the valuable papers, so that the papers are not damaged.

In addition, after cutting the small strap k, the pair of strap catchers 50A and 50B are moved in a direction in which the catchers come apart from each other, so that the small strap k is loosened and the layered valuable papers recover their horizontal positions. Thereafter, the layered valuable papers are extracted. Accordingly, the papers are prevented from falling during extraction.

Further, when collecting the small strap k, both end portions of the small strap k are clamped and carried by the carrier catch arm 82 and stored into a cassette, after the pair of strap catchers 50A and 50B are let recover their initial positions, i.e., after the small strap recovers the same state as it was sealed before. Accordingly, small straps k can be stored in the cassette with their situations maintained as they were sealed before, without changing the order of their own. Therefore, later processing of small straps k is facilitated.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A strap processing apparatus comprising:

carrying means for carrying a bundle of papers, said bundle of papers comprising a predetermined number of layered papers held together with a sealing strap;

a clearance forming means for bending the bundle of papers carried by the carrying means to thereby form a clearance between a surface portion of the layered papers and the sealing strap;

a pair of clamps for clamping a portion of the sealing strap after said clearance is formed, said pair of clamps being separated by a predetermined distance;

a cutting tool for cutting an intermediate portion of the sealing strap clamped by the pair of clamps;

a moving means for moving the pair of clamps in a direction in which the pair of clamps are moved apart from each other to thereby loosen the sealing strap, after cutting the sealing strap with the cutting tool; and extracting means for clamping and carrying the papers, thereby extracting the papers from the sealing strap, after the sealing strap is loosened by the moving means.

2. An apparatus according to claim 1, wherein the clearance forming means for bending the bundle of papers comprises a pushing means for pushing both side portions of one surface of the bundle of papers, and a receiving means for receiving a center portion of an opposing surface of the bundle of papers pushed by the pushing means.

3. An apparatus according to claim 2, wherein the pushing means and the receiving means are constituted by carrier belts.

4. An apparatus according to claim 1, wherein the clearance forming means also serves as the extracting means.

5. A strap processing apparatus according to claim 1, further comprising:

controlling means for making control such that the pair of clamps are returned to an initial position by the moving means, after the layered papers are extracted from the sealing strap by the extracting means;

strap carrying means for clamping the sealing strap to receive the sealing strap and for carrying the sealing strap, after the pair of clamps are returned to the initial position; and collecting means for receiving and storing the sealing strap carried by the strap carrying means into a cassette.

6. A strap processing apparatus according to claim 5, wherein said strap carrying means has a catch arm for receiving both end portions of the sealing strap with the sealing strap clamped by the pair of clamping means.

7. A paper processing apparatus comprising:

carrying means for carrying a bundle of papers, said bundle of papers comprised of a predetermined number of layered papers held together with a sealing strap;

a clearance forming means for bending the bundle of papers carried by the carrying means to thereby form a clearance between a surface portion of the layered papers and the sealing strap;

a pair of clamps for clamping a portion of the sealing strap after said clearance is formed, said pair of clamps being separated by a predetermined distance;

a cutting tool for cutting an intermediate portion of the sealing strap clamped by the pair of clamps;

moving means for moving the pair of clamps in a direction in which the pair of clamps in a direction in which the pair of clamps are moved apart from each other thereby to loosen the sealing strap, after cutting the sealing strap with the cutting tool;

extracting means for clamping and carrying the papers, thereby extracting the papers from the sealing strap, after the sealing strap is loosened by the moving means so that the layered papers are rendered horizontal;

feeding means for receiving the layered papers extracted from the extracting means and for feeding the layered papers;

pick-up means for picking up the papers, one after another, from the layered papers fed by the feeding means;

determining means for determining information of the papers picked up by the pick-up means;

piling means for piling the papers, for every predetermined number of sheets, based on the information determined by the determining means; and bundling means for bundling the papers piled by the piling means with a bundling strap.

8. A paper processing apparatus comprising:

carrying means for carrying a bundle of papers, said bundle of papers comprised of a predetermined number of layered papers held together with a sealing strap;

a clearance forming means for bending the bundle of papers carried by the carrying means to thereby form a clearance between a surface portion of the layered papers and the sealing strap;

a pair of clamps for clamping a portion of the sealing strap after said clearance is formed, said pair of clamps being separated by a predetermined distance;

a cutting tool for cutting an intermediate portion of the sealing strap clamped by the pair of clamps;

moving means for moving the pair of clamps in a direction in which the pair of clamps are moved apart from each other thereby to loosen the sealing strap, after cutting the sealing strap with the cutting tool;

extracting means for clamping and carrying the papers, thereby extracting the papers from the sealing strap, after the sealing strap is loosened by the moving means;

controlling means for making control such that the pair of clamps are returned to an initial position by the moving means, after the layered papers are extracted from the sealing stray by the extracting means;

strap carrying means for clamping the sealing strap to receive the sealing strap and for carrying the sealing strap, after the pair of clamps are returned to the initial position, said strap carrying means having a catch arm for receiving both end portions of the sealing strap with the sealing strap clamped by the pair of clamps;

collecting means for receiving and storing the sealing strap carried by the strap carrying means, into a cassette;

feeding means for receiving the layered papers extracted from the extracting means and for feeding the layered papers;

pick-up means for picking up the papers, one after another, from the layered papers fed by the feeding means;

determining means for determining information of the papers picked up by the pick-up means;

piling means for piling the papers, for every predetermined number of sheets, based on the information determined by the determining means; and bundling means for bundling the papers piled by the piling means with a bundling strap.

* * * * *